US005824447A

United States Patent [19]

Tavernier et al.

[11] Patent Number: 5,824,447

[45] Date of Patent: Oct. 20, 1998

[54] APPARATUS FOR SECURITY PRINTING USING TONER PARTICLES

[75] Inventors: Serge Tavernier, Lint; Dirk Broddin, Edegem; Stefaan De Meutter, Antwerp; Leon Vermeulen, Herenthout; Michel Boulonne, Kappelle-op-den-Bos, all of Belgium

[73] Assignee: AGFA-Gevaert, N.V., Mortsel, Belgium

[21] Appl. No.: 889,301

[22] Filed: Jul. 8, 1997

[30] Foreign Application Priority Data

Jul. 11, 1996 [EP] European Pat. Off. ..... 96201964

[51] Int. Cl.[6] ..... G03G 13/20

[52] U.S. Cl. ..... 430/124; 399/335

[58] Field of Search ..... 430/10, 47, 120, 430/124; 399/335

[56] References Cited

U.S. PATENT DOCUMENTS

| | | | |
|---|---|---|---|
| 5,366,833 | 11/1994 | Shaw et al. | 430/10 |
| 5,407,773 | 4/1995 | Furuta et al. | 430/99 |
| 5,532,100 | 7/1996 | Christy et al. | 430/120 |

FOREIGN PATENT DOCUMENTS

| | | |
|---|---|---|
| 0 601 235 A1 | 6/1994 | European Pat. Off. . |
| 0 629 924 A1 | 12/1994 | European Pat. Off. . |
| 0 712 881 A1 | 5/1996 | European Pat. Off. . |
| WO 93/04868 | 3/1993 | WIPO . |

*Primary Examiner*—John Goodrow
*Attorney, Agent, or Firm*—Breiner & Breiner

[57] ABSTRACT

An apparatus for security printing of a document on a substrate, having a first and second side, comprising:

i) means for feeding variable data in a predetermined digital format to printing stations, ii) at least two printing stations, for image-wise depositing, in accordance to the predetermined format of the variable data, toner particles on the substrate, iii) means for fusing the toner particles to the substrate, to form a fused toner image, characterized in that a) the apparatus comprises means for introducing security features in the document and b) the means for fusing the toner particles to the substrate comprise means for heating and melting the toner particles such that between the melting toner particles and the substrate a contact angle of at most 90° is formed and leave at most 25 mg/m$^2$ of an external releasing agent on the fused toner image.

13 Claims, No Drawings

APPARATUS FOR SECURITY PRINTING USING TONER PARTICLES

1. FIELD OF THE INVENTION

This invention relates to an apparatus and a method for printing variable data on a substrate comprising security features by means of toner particles.

2. BACKGROUND OF THE INVENTION

Several documents, e.g. passports, visas, identity cards, driver licenses, bank cards, credit cards, security entrance cards, etc, must be made forgery-free to avoid fraudulent use of these documents. Therefore not only the finished document comprises security features, but also the paper on which such documents are printed comprises already several security features. Such features are inclusions of materials in the bulk of the paper, e.g. watermarks, special relief pattern on the paper surface, fibres, security threads, light diffraction marks, etc. Paper including such security features may not present an even smooth surface for printing and therefore it is not very straightforward to print even density patches on security paper when using contact-printing methods.

Logically then, methods for printing on security paper are to be found in the field of non-impact printing. Among the most common methods of non-impact printing are electro (photo)graphy, ink-jet printing, thermosublimation printing and Direct Electrostatic Printing.

Thermosublimation printing is not well suited for printing on rough surfaces and mostly a dye accepter layer is necessary on the substrate. Thermosublimation printing, that proceeds by thermally evaporating solid dye or pigments, is not very well suited for security printing because of the dyes, usually used, are not sufficiently waterfast and lightfast, and are characterized by high bleeding, leading to documents with a restricted shelf life. Thermosublimation printing does thus not offer an adequate possibility for printing on security paper.

Ink-jet printing offers at first sight interesting possibilities for printing on paper with a very rough surface, but is not very well suited for printing security documents. The dyes or pigments, usually used in ink-jet printing, are not sufficiently waterfast and lightfast to be used in security documents. Moreover, in ink-jet printing also, an ink-receiving layer is necessary on the substrate.

Therefore electro(photo)graphic and Direct Electrostatic Printing are preferred non-impact printing methods for security printing. The advantage of these methods is that they use pigmented and or dyed toner particles that are fused to the substrate, and that in the preparation of said toner particles the chemical structure of the pigments or dyes (chemical structure defining largely the water- and lightfastness) that are used is not very critical. Thus in the production of toner particles a wide range of different pigments and dyes can be used. It is, e.g., possible to incorporate nacreous, iridescent or interference pigments, etc, in the toner particles, without interfering with the usefulness of this toner particles in the printing methods. Also toner particles with special physical properties (magnetic, dielectric, etc) and useful in security printing can easily be manufactured without interfering with the usefulness of this toner particles in the various printing methods.

Security printing with electrostatography has been described in e.g. U.S. Pat. Nos. 5,366,833 and WO 93/04868. Both these disclosures stress the risk that images (or information) printed with toner particles does not adhere sufficiently well to the substrate. Therefore, these disclosures claim methods for having an image that can still be seen even when the original toner particles are removed and replaced, for a method to change the original toner image in such a way that other toner particles, replacing the original ones, do not have the same optical properties.

Since electrostatographic printing methods, both Direct Electrostatic Printing and classical electrophotography, are ever more accepted in the world of printing, further improvements in electrostatographic printing of security documents is desirable.

3. OBJECTS AND SUMMARY OF THE INVENTION

It is an object of the invention to provide an apparatus for electrostatographic security printing of variable data on substrates wherein the toner particles adhere strongly to said substrate.

It is a further object of the invention to provide an apparatus for electrostatographic printing of variable data on substrates, wherein a variety of security features can be included in the printed variable data.

It is still a further object of the invention to provide an apparatus for electrostatographic printing of variable data on substrates already comprising security features wherein a variety of additional security features can be included in the printed variable data during a single pass in the apparatus.

It is another object of the invention to provide an apparatus for security printing of variable data delivering printed matter that easily can be laminated with any means known in the art of laminated security document and that exhibits strong adhesion on the portions of the document comprising toner particles as well as on the portions not carrying toner particles.

Further objects and advantages of this invention will become clear from the detailed description hereinafter.

The objects of this invention are realized by providing an apparatus for security printing of a document on a substrate, having a first and second side, comprising:

i) means for feeding variable data in a predetermined digital format to printing stations, ii) at least two printing stations, for image-wise depositing, in accordance to said predetermined format of said variable data, toner particles on said substrate, iii) means for fusing said toner particles to said substrate, to form a fused toner image, characterized in that a) said apparatus comprises means for introducing security features in said document and b) said means for fusing said toner particles to said substrate comprise means for heating and melting said toner particles such that between said melting toner particles and said substrate a contact angle of at most 90° is formed and leave at most 25 mg/m$^2$ of an external releasing agent on said fused toner image.

4. DETAILED DESCRIPTION OF THE INVENTION

It was found that the problem of adhesion of toner particles to a substrate could be eliminated, as necessitated, especially in security printing, by fusing the toner particles in such a way toner particles and the substrate is below 90°, preferably below 45°, most preferably lower than 30°. It seems that then the interpenetration and bonding between toner and substrate is optimized. The fusing under a contact angle lower than 90°, preferably lower than 45°, most preferably lower than 30°, can be brought about by the construction of the fusing means, present in the apparatus according the present invention. The fusing means in an apparatus according to the present invention can e.g. comprise a section wherein non-contact fusing e.g. by radiant heat, preferably by IR radiation is performed, and that is followed by a section wherein an adjustable pressure is exerted on the fused toner image by a pressure roller. The pressure roller exerts preferably a pressure, per linear nip-length, on the fixed image of between 100 N/m and 500 N/m, and the post-treatment proceeds for a time preferably between 30 and 150 msec. There are, according to the present invention, two modes of operating said post-treatment. Said two modes differ in the temperature of said post-treatment. In a first mode the almost cold, having been allowed to cool after leaving the non-contact fusing station, fused image is passed through rollers said rollers having a temperature between 20° C. below and 20° C. above the softening temperature of the toner resin, which means in most cases a temperature of around 120° C. In a second mode of operation, the fused image is directly, without allowing it to cool, passed from the fusing station through a rollers, where essentially no additional heat is added to the fixed image, but where the temperature of the post-treatment rollers is kept between 5° C. below and 15° C. above the Tg of the toner resin.

The contact angle between fusing (melting) toner particles and the substrate can also be controlled by the proper design of the toner particles. The use of toner particles having a meltviscosity $\eta$at 120° C. such that 100 Pas $\leqq \eta \leqq$ 1500 Pas, preferably such that 100 Pas $\leqq \eta \leqq$1000 Pas, makes it easier to reach a low contact angle between melting toner particles and the 30 substrate. All meltviscosities mentioned herein are measured in a RHEOMETRICS dynamic rheometer, RVEM-200 (One Possumtown Road, Piscataway, N.J. 08854 USA). The viscosity measurement is carried out at a sample temperature of 120° C. The sample having a weight of 0.75 g is applied in the measuring gap (about 1.5 mm) between two parallel plates of 20 mm diameter one of which is oscillating about its vertical axis at 100 rad/sec and amplitude of $10^{-3}$ radians. The toner particles can also comprise fluidity improvers (low molecular weight surface active compounds, comprising e.g. fluoro atoms that are still working at the fusing temperature) or can comprise a toner resin improving the fluidity of the melting toner particles. Such resins are described in EP-A 712 881, that is incorporated herein by reference. Basically such resins are amorphous complex macromolecular compounds that comprises in the macromolecular structure, (i) an amorphous polycondensation backbone, the corresponding backbone polymer (A) having a Tg of at least 45° C. and (ii) at least one polymer chain (B) being attached to said backbone, either terminally and/or in a side-chain, said polymer chain (B) being derived from a polymer which on itself has an average molecular weight by number ($M_{avg}$) so that 400 $\leqq M_{avg} \leqq$ 4000, a melting point between 50° C. and 150° C. and a melting range of at most 15° C.

The contact angle between the melting toner particles and a substrate can also be adjusted by adjusting the surface of the substrate to the properties of the toner particles. When e.g. the toner particles comprise as toner resin essentially polyesters, it can be beneficial for lowering the contact angle between the melting toner particles and the substrate, to apply on the surface of the substrate, before the deposition of toner particles, a "surface adjusting coating" also comprising essentially a polyester. By doing so the compatibility between the melting toner resin (particles) and the surface of the substrate is enhanced. Very suitable polyesters for use in said "surface adjusting coating" are polyesters in latex form comprising sulphonic acid groups in the recurring units: e.g. a copolyester containing recurring ester groups derived from ethylene glycol and an acid mixture containing terephthalic acid, isophthalic acid and 5-sulphoisophthalic acid whose sulpho group is in salt form, said acid mixture consisting essentially of from 20 to 60 mole % of isophthalic acid, 6 to 10 mole % of said sulphoisophthalic acid, 0.05 to 1 mole % of cross-linking agent being an aromatic polycarboxylic acid compound having a least three carboxylic acid groups or corresponding acid generating anhydride or ester groups, the remainder in said acid mixture being terephthalic acid. The substrate can be treated with such a "surface adjusting coating" before entering the substrate in an apparatus according to the present invention. When a "surface adjusting coating" as described above is needed, it is also possible to apply said solution in an apparatus according to the present invention that case an apparatus according to the present invention comprises further means for applying said "surface adjusting coating" and has said means installed before the first printing stations.

The measures to lower the contact angle between the melting toner particles and the substrate described above, can, within the scope of the present invention, be implemented individually or can be implemented together. It is possible to enhance the hardness and the bonding of layers of toner images to the substrate to harden the toner layers either by application of an hardener or by including radiation curable compounds in the toner particles. The hardening of the toner layers proceeds either during the fusing step (by heat) or by irradiation (by UV light, when the radiation curable compounds are UV-curable). The hardening can involve both heating and UV-irradiation if necessary.

An other problem encountered when using toner particles to print variable data on a substrate is that it is difficult to laminate firmly a protective foil on top of the printed information. Such an protective foil can optionally also comprise security features, e.g. wire, special wrinkles, UV absorbers, etc. The difficultipkawes encountered in laminating a protective foil on a toner images are due to the fact that toner images are often fixed by heat and pressure, e.g., by a hot roller pressure fusing device. On such a pressure roller silicone oil is mostly present to avoid hot-offset of the toner particles. The amount of silicone oil that has to be present on the hot pressure roller, to completely avoid hot-offset is rather high. Especially in the case of printing images in full color, the amount of silicone oil present at the surface of the image, after contact fusing, is between 400 mg/m$^2$ and 1600 mg/m$^2$. In security printing, where a strong adhesion of the toner layers to the substrate is a must and the colors have to be well intermixed, it is necessary to use toner particles with high fluidity during the fusing. When not well fused toner images are present in security documents, the toner image can easily be pealed off and replaced by another image. Toner particles with high fluidity during fusing have a low meltviscosity and are very prone to hot-offset. In security printing eventual hot-offset and attempts to tamper with the document can both look as a damaged image and thus hot-offset during the legal making of the document has to be avoided. Thus large amounts of silicone oil (releasing agent) are necessary on external releasing agent) present on the surface of the printed image is so adhesive that the firm and long lasting lamination of a protective foil to the image is almost impossible. Therefore in an apparatus according to the present invention, the fusing means are so construed that the fusing proceeds mainly, preferably exclusively, by non-contact means. Non-contact fusing means according to this invention can include a variety of embodiments, such as: (1) an oven heating process in which heat is applied to the toner image by hot air over a wide portion of the support sheet, (2) a radiant heating process in which heat is supplied by infrared and or visible light absorbed in the toner, the light source being e.g. an infrared lamp or flash lamp. According to a particular embodiment of "non-contact" fusing the heat reaches the non-fixed toner image through its substrate by contacting the support at its side remote from the toner image with a hot body, e.g., a hot metallic roller. In the present invention, non-contact fusing by radiant heat, e.g., infrared radiation (IR-radiation), is preferred. As explained above the means for fusing in an apparatus according to the present invention can comprise a section wherein an adjustable pressure is exerted on the fused toner image by a pressure roller, in order to improve the contact between molten toner particles and lower the contact angle between the melting toner particles and the substrate. If necessary a small amount silicone oil (or other external releasing agent) can be present on the surface of these pressure rollers. But it is very desirable that the amount of releasing agent present on the surface of these pressure rollers is such that no more than 25 mg of releasing agent is applied per $m^2$ of printed image, preferably no more than 15 $mg/m^2$. When the amount of releasing agent on the pressure rollers is larger and leaves an amount of releasing agent larger than 25 $mg/m^2$ on the image, the apparatus according to the present invention, comprises further means to restrict said amount of releasing agent on top of the image. It was found that an amount of releasing agent of 25 $mg/m^2$ did not diminish the possibility to laminate firmly and permanently a protective foil on the image to an unacceptable degree, but within the scope of the present invention it is preferred to design the means for fusing the toner particles in such a way that no releasing agent is necessary.

In an apparatus according to the present invention the ways, that can be implemented alone or in combination:

- the security features can be present in the substrate (e.g. watermarks, wires, micro-printing, etc), typical substrates including security features are available through Portals (Bathford) Ltd, 253 London Road East, Batheaston, Bath, Avon, England.
- the security features can be introduced in the document via the toner particles (special pigmentation, incorporation of nonfusible additives, etc). Such toner particles are described hereinafter.
- the security features can be introduced via the predetermined digital format in which the variable data are presented to the printing stations (halftone/contone, screening with various angles, overlaying toner particles, registering features of the variable data with features in the substrate, registering on both sides of a transparent or translucent substrate, etc). It is clear that, in an apparatus according to the present, security printing with a combination of various security features is possible in a simple way, using a single apparatus in a single pass.

In an apparatus according to the present invention it is preferred that at least two means for image-wise depositing toner particles (hereinafter called "printing stations") are present and the variable data to be printed are presented to said printing stations in a digital way. This has the advantage that it is possible to incorporate various security features in the printed variable data themselves in addition to the security features already present in the substrate. It is e.g. possible to predetermine the digital format of the variable data in such a way that a portion of the variable data to he printed is sent to one printing station and an other portion to another printing station. When in both printing stations a different type of toner particles is present, e.g. in one printing station a simple pigmented toner and in the second a toner including also UV-fluorescent pigments, it is possible to print a portion of the variable data with one toner type, wherein no fluorescence is present and another portion with a UV-fluorescent toner. This makes the tampering of a security document more difficult. The presence of at least two printing stations in an apparatus according to this invention, makes it possible to realize additional security features in the printed variable data themselves, in a single pass, i.e. the manipulations of the document during printing is lower, thus allowing to include more security features in one document without loss of time and/or excessive costs. It is preferred that an apparatus according to the present invention comprises at least four, more preferably at least five printing stations. By having this number of printing stations full color printing, yellow, magenta, cyan, and black (YMCK) is possible and having a fifth printing station makes it possible to apply anywhere within or on the printed variable data toner particles including specific security features.

In a apparatus according to the present invention said printing stations can be direct electrostatic printing stations, wherein charged toner particles are attracted to the substrate by an electrical field and the toner flow modulated by a printhead structure comprising printing apertures and control electrodes. In such printing stations no latent image is formed, and the variable data to be printed are directly printed on the substrate. Said printing stations can also be printing stations wherein first a latent image is formed. In such an apparatus, within the scope of the present invention, said printing station (means for image-wise depositing toner particles) comprise

- means for producing a latent image on a latent image bearing member,
- means for developing said latent image by the deposition of said toner particles, forming a developed image and
- means for transferring said developed image on said substrate comprising security features.

Said latent image may be a magnetic latent image that is developed by magnetic toner particles (magnetography) or preferably an electrostatic latent image. Such an electrostatic latent image is preferably an electrophotographic latent image and the means for producing a latent image are in this invention preferably light emitting means, being a member selected from the group of light emitting diodes and lasers and said latent image bearing member comprises preferably a photoconductor. Said means for developing said latent image by the deposition of said toner particles, can be any means known in the art e.g. a device using mono component non-magnetic toner, but comprise preferably a magnetic brush. This magnetic brush can be of the type stationary core rotating sleeve, which is preferred and of the type stationary sleeve rotating core. The developer used in the magnetic brush can be mono-component magnetic developer, but is preferably a two (multi) component developer comprising magnetic carrier particles and toner particles. The toner particles can be negatively charged as well as positively charged.

Security printing with toner particles can beneficially proceed in an apparatus according to the present invention, wherein said at least two printing stations are located on so that said variable data are printed on both sides of said substrate. In an apparatus according to the present invention wherein printing stations are present, enabling printing on both sides of the substrate, it is preferred that for printing on each side at least two preferably at least four and more preferably at least five printing stations are present. By having a printing system for security printing that makes it possible to print in a single pass on both sides of a substrate with various types of toner particles enhances greatly the number of security features that can additionally be included in the printed variable data themselves (additional to the security features already present in the substrate).

Typical printing apparatus making it possible to print on both sides of a substrate in a single pass have been disclosed in e.g. EP-A 629 924, European Application 95201185 filed on May 9, 1995 and European Application 95201186 filed on May 9, 1995.

A printing apparatus according to the present invention can further comprise means for registering features included in said variable data with features included in said substrate or for registering different image portions with respect to each other. E.g. when in the substrate a red dot is present said registering means make it possible to exactly overly said red dot by e.g. a yellow toner, yielding an orange dot in the security document. Such a registering can be incorporated in the predetermined digital format with which the variable data are fed to the printing stations. Said means for registering comprise e.g. a reader for marks on the substrate, means for converting the readings of these marks in positioning signals for one or more printing stations and means for accurately positioning said printing station(s). The means for positioning said printing stations can be mechanical means or the positioning can proceed by digital data-shift. When the apparatus according to this invention is a duplex printer (prints on both sides of the substrate in a single pass) the apparatus can beneficially comprise registering means for registering features included in the variable data printed on the first side with features included in variable data printed on the second side. This can be a valuable asset when printing on transparent or translucent substrate, optionally comprising security features. It is also possible in security printing to use both said means for registering to expressly mis-register all or portions of the data so increasing the difficulty for forging the printed security document.

An apparatus according to the present invention present many advantages for security printing :

- the toner particles adhere strongly to the substrate,
- on top of the printed variable data it is possible, if so desired, to laminate strongly and permanently a protective or other foil,
- the apparatus comprises a variety of printing station making it possible to include various security features in the printed variable data in addition to the security features already present in the substrate and thus clearly enhancing the security of the document (increasing the resistance to forgery),
- the apparatus makes the increase of the resistance to forgery possible in a single pass fast printing, saving valuable time and money.

The security features that can be incorporated in the variable data, printed in an apparatus according to this invention, in addition to the security features already present in the substrate whereon the variable data are printed, can largely be realized by using special toner particles. The toner particles can comprise, any know toner ingredient e.g. charge control agents, pigments both colored and black, dyes, release agents, resistivity regulating agents, anorganic fillers, etc. A description a charge control agents, pigments and other additives useful in toner particles, to be used in a toner composition according to the present invention, can be found in e.g. EP-A 601 235. The toner particles can apart from the normal ingredients as described above, comprise ingredients that will add security features to the printed matter. Thus the toner particles can comprise fluorescent pigments, phosphorescent pigments, iridescent pigments, luminescent pigments, etc or a combination. The toner particles can comprise metallic or plastic non-melting particles, metallic or plastic wires, magnetic pigments (both soft magnetic pigments and hard magnetic pigments), or mixtures. It can be transparent toners with magnetic properties by incorporating carbonyl-iron in the particles. It is possible to introduce pigments having a color laying outside of the color gamut printable by normal photocopiers in such a way that photocopying of the document is impossible. It is also possible to incorporate in the toner particles along with the normal pigmentation a small amount slightly differently colored and UV-fluorescent pigment, so that in an patch of even density fluorescent points of different color can be seen under UV irradiation. It is within the scope of the invention also possible to blend types of toner particles in one printing station. E.g. a large amount of cyan toner is blended with a small amount (a few percent) of toner particles having a different pigmentation (different in color, in fluorescence, in magnetic properties, etc), in an for the naked eye even patch of cyan different pigments are detectable in e.g. UV illumination, in a magnetic field, etc depending on the properties of the differing pigment.

The toner particles, useful in a apparatus according to this invention, have an average volume diameter between 1 and 50 $\mu$m, preferably between 3 and 20 $\mu$m. When the toner particles are intended for use in color imaging, it is preferred that the volume average diameter is between 3 and 10 $\mu$m, most preferred between 3 and 8 $\mu$m. The particle size distribution of said toner particles can be of any type. It is however preferred to have an essentially (some negative or positive skewness can be tolerated, although a positive skewness, giving less smaller particles than an unskewed distribution, is preferred) Gaussian or normal particle size distribution, either by number or volume, with a coefficient of variability (standard deviation divided by the average) (v) smaller than 0.5, more preferably of 0.3.

Additional security features in the printed variable data can be added due to the structure of an apparatus according to this invention. The fact that several printing stations are present and preferably on both sides of the substrate makes it possible, by including printing instructions in the predetermined digital format with which the variable data are sent to the printing stations, to effect various tamper free or at least very difficult to forge features in the printed document. It is e.g. possible to overlay toner particles, to print some of the variable data, that have to be printed in black, with black toner (having a black pigment) and the rest with overlay of yellow, magenta and cyan toner particles. It is possible to overlay black portions with a transparent but pigmented layer with e.g. a transparent yellow toner, thus for the naked eye the black seems uncovered. The presence of various printing stations in an apparatus according to this invention makes it possible to add various layers, imagewise, overall, counter image-wise, of toners including security enhancing elements. The possibility of registering, as described above, enhances also the possible security elements in the printed variable data.

Since the printing stations are preferably fed with variable data to be printed in digital form and the printing it self is digitally monitored, it is possible in an easy and economically sound way to print portion of the data using a screen with e.g. an angle of 150° and an other portion with an angle of e.g. 100°. The different angle can easily be checked with, in the art of printing, readily available screen plates. The screens can also differ in number of lines. A portion of half-tone data to be printed (e.g. the photograph of the document bearer) can be printed by an halftone screen and an other portion in pure contone. In a printing apparatus according to this invention it is possible to print lines wherein on the level of specific pixels "pixel jumping" is present in a preset pattern. This means that a, for the naked eye straight line, shows on a microscopic scale a kind of crenellation. In fact the fact alone that the variable data are present in a predetermined digital format and can, in an apparatus according to this invention, be fed to a large number of printing stations, all imaginable digital image manipulations are possible and can be implemented to provide security features in the printed document. E.g. in halftone images it is possible to deviate expressly from the tonal range, when printing on a transparent substrate the same portion of the image can be printed on both sides of the image, but screened with a different angle, which results in a visible moire pattern, etc. The present invention includes also a method for security printing of a document a substrate, having a first and second side, comprising the steps of:

i) feeding variable data in a predetermined digital format to at least two printing stations, ii) providing at least two different types of toner particles, iii) image-wise depositing said different types of toner particles on at least one side of said substrate, iv) introducing security features in said document, v) heating and melting said toner particles such that said melting toner particles are fused to said substrate and that between said melting toner particles and said substrate a contact angle of at most 90° is formed, vi) restricting an optional amount of external releasing agent on top of said fused toner particles to at most 25 $mg/m^2$.

We claim:

1. A single pass apparatus for security printing of a document on a substrate, having a first and second side, comprising:

i) means for feeding variable data in a predetermined digital format to a plurality of printing stations, ii) at least two printing stations for image-wise depositing toner particles on said substrate in accordance with said predetermined format of said variable data, iii) means for non-contact fusing said toner particles to said substrate by radiant heat, thereby forming a fused toner image, wherein a) said apparatus further includes means for introducing security features in said document and b) said means for fusing said toner particles to said substrate includes means for heating and melting said toner particles whereby between said melting toner particles and said substrate a contact angle of at most 900° is formed and leave at most 25 $mg/m^2$ of an external releasing agent on said fused toner image.

2. An apparatus according to claim 1, wherein said means for introducing security features in said document are incorporated in said substrate.

3. An apparatus according to claim 1, wherein said means for introducing security features in said document are incorporated in said toner particles.

4. An apparatus according to claim 1, wherein said means for introducing security features in said document are incorporated in said predetermined digital format.

5. An apparatus according to claim 1, further comprising means for registering features included in said variable data with features included in said substrate.

6. An apparatus according to claim 1, comprising at least five printing stations and each of said printing stations containing a different type of toner particles.

7. An apparatus according to claim 1, wherein said at least two printing stations are located in such a way that said variable data are printed both on said first and said second side of said subtrate.

8. An apparatus according to claim 7, wherein said variable data printed by said printing means on said first side of said substrate differ from said variable data printed by said printing means on said second side of said substrate.

9. An apparatus according to claim 7, further comprising means for registering features included in said variable data printed on said first side with features included in said variable data printed on said second side.

10. An apparatus according to claim 1, further comprising a means for applying a "surface adjusting coating" to said substrate and wherein said means for applying a "surface adjusting coating" is installed before said printing stations.

11. A method for security printing of a document a substrate, having a first and second side, comprising the steps of:

i) feeding variable data in a predetermined digital format to at least two printing stations, ii) providing at least two different types of toner particles, iii) image-wise depositing said different types of toner particles on at least one side of said substrate, iv) introducing security features in said document, v) heating and melting said toner particles in non-contact mode by radiation heat such that said melting toner particles are fused to said substrate and that between said melting toner particles and said substrate a contact angle of at most 900° is formed, vi) depositing an amount of external releasing agent on top of said fused toner particles of at most 25 $mg/m^2$.

12. An apparatus according to claim 1, wherein said toner particles include a toner resin having a Tg and a softening point and after said means for fusing said toner particles said apparatus further includes a pressure roller at a temperature between 5° C. below and 15° C. above said Tg, for applying a post-treatment to the fused image.

13. An apparatus according to claim 12, wherein said pressure roller is at a temperature between 20° C. below and 20° C. above said softening point of said toner resin.

* * * * *

UNITED STATES PATENT AND TRADEMARK OFFICE

CERTIFICATE OF CORRECTION

PATENT NO. : 5,824,447

DATED : October 20, 1998

INVENTOR(S) : Serge Tavernier et al

It is certified that error appears in the above-indentified patent and that said Letters Patent is hereby corrected as shown below:

Column 2, line 64, "in such a way toner particles" should read -- in such a way that during the fusing step the contact angle between the molten toner particles --;

Column 3, line 34, "and the 30 substrate." should read -- and the substrate. --;

Column 4, line 22, "present invention that case" should read -- present invention. In that case --;

Column 4, line 65, "are necessary on external releasing agent)" should read -- are necessary on the hot pressure rollers. A high amount of silicone oil (an external releasing agent) --;

Column 5, lines 39-40, "present invention the ways," should read -- present invention the security features can be introduced in the document in several ways, --;

Column 6, lines 16-17, "in a single pass, i.e. the manipulations" should read -- in a single pass, i.e. the printing speed is not diminished and the need for manual manipulations --;

UNITED STATES PATENT AND TRADEMARK OFFICE

CERTIFICATE OF CORRECTION

PATENT NO. : 5,824,447

DATED : October 20, 1998

INVENTOR(S) : Serge Tavernier et al

It is certified that error appears in the above-indentified patent and that said Letters Patent is hereby corrected as shown below:

Claim 1, column 10, line 1, "at most 900° is formed" should read -- at most 90° is formed --;

Claim 11, column 10, line 49, "at most 900° is formed," should read -- at most 90° is formed, --.

Signed and Sealed this

Twenty-seventh Day of April, 1999

*Attest:*

Q. TODD DICKINSON

*Attesting Officer*

*Acting Commissioner of Patents and Trademarks*